US005259232A

United States Patent [19]

Schweitzer

[11] Patent Number: 5,259,232

[45] Date of Patent: Nov. 9, 1993

[54] BENDING MACHINE

[76] Inventor: Leonard J. Schweitzer, 3272 Susilen Dr., Reno, Nev. 89509

[21] Appl. No.: 817,096

[22] Filed: Jan. 6, 1992

[51] Int. Cl.[5] ..... B21D 7/00

[52] U.S. Cl. ..... 72/389; 72/213; 72/308

[58] Field of Search ..... 72/389, 458, 472, 213, 72/308, 384, 457, 212

[56] References Cited

U.S. PATENT DOCUMENTS

| | | | |
|---|---|---|---|
| 1,664,138 | 11/1926 | Sundgren . | |
| 2,533,325 | 12/1950 | Miller et al. | 72/212 |
| 3,912,251 | 10/1975 | Fraser et al. | 269/228 |
| 3,918,286 | 11/1975 | Whitehead | 72/213 |
| 4,304,117 | 12/1981 | Rawson | 72/388 |
| 4,485,664 | 12/1984 | Richards | 72/212 |
| 4,594,875 | 6/1986 | Schweitzer | 72/389 |
| 4,794,779 | 1/1989 | Schweitzer | 72/389 |
| 4,798,078 | 1/1989 | Schweitzer | 72/389 |
| 4,887,447 | 12/1989 | Schweitzer | 72/332 |
| 4,989,441 | 2/1991 | Wagner | 72/213 |

*Primary Examiner*—David Jones

[57] ABSTRACT

A hand operated rebar bender and bent bar straightener which includes a base, a pair of spaced apart bending posts and a linearly reciprocal slide disposed between the posts and movable reciprocally in directions perpendicular to a line interconnecting the posts. The slide defines a first and second groove, both adapted to receive rebar, which move with the slide. The first groove is positioned so that straight rebar to be bent is originally tangent to the peripheries of the posts. The improvement of the present invention includes mechanical advantage which each movement of the handle moves the slide in increments thus allowing a person of lessor strength to comfortably bend heavy rebar such as #5. Also, a unique automatic or manual reversing mechanism is disclosed which allows the handle to be used in only one direction for straightening rebar as well as bending it.

10 Claims, 7 Drawing Sheets 93
93
81
112
112
91
30
85
83
83
89
87
58
52
54
52
54

BENDING MACHINE

BACKGROUND OF THE INVENTION

This invention relates to an apparatus for cutting metal bars, such as bars used during construction to reinforce concrete, generally known as rebars, and in particular to such a device which is portable and can be used on the ground at construction sites.

U.S. Pat. No. 4,594,875, issued Jun. 17, 1986 to the inventor hereof, the disclosure of which is incorporated herein by reference, disclosed and claims an improved rebar bending machine which is lightweight, hand operated and adapted to be used in the field by a single person. It has a laterally stabilized, elongated base and, mounted to the base, a pair of spaced apart forming posts which straddle a slide mounted pair of lugs that form between them a groove into which rebar to be bent is placed. The slide is movable in an elongated guideway in a direction perpendicular to a line interconnecting the centers of the forming posts so that the groove defined by the lugs can be moved from a first position, at which a rebar placed in the groove is substantially tangent to the peripheries of the posts, past the line interconnecting the post centers, to a second position on the other side of the posts. In the course of this linear movement of the grooves a bend is formed in that portion of the rebar disposed between the lugs. Depending upon the length of travel of the lugs a bend of less than equal to or greater than 90 degrees is formed in the rebar although 90 degree bends are by far the most common.

That patent further disclosed to generate the relatively large bending forces with an elongated handle that is pivotally attached to the base. Suitable linkage connected to the handle and the slide translated the pivotal handle movements into linear slide motions.

To minimize the weight of the bending machine and to maximize the bending force, the slide, post and linkage are arranged so that the slide does not travel substantially more than the distance it must travel to effect the greatest bend in the bar, typically a bend of not more than about 120 degrees. In this manner, the overall length of the device in general and of the slide, base and guideway in particular can be minimized, which saves weight, labor and costs. Within a given size and configuration of the machine, the bending force that can be generated with the manually operated handle can be maximized. An effective, high speed and accurate bending of the rebar is thus possible with the device of that patent.

Bending machines constructed in accordance with the above-mentioned patent have been on sale for more than three years and have met with exceptional success. It is believed that the success is to a large extent attributable to its compact size, relatively low weight and to its easy operation even on the uneven ground frequently encountered at construction sites.

U.S. Pat. No. 4,794,779, issued Jan. 3, 1989 to the inventor hereof, the disclosure of which is incorporated herein by reference, significantly improves the usefulness of the bending machine disclosed in the above discussed '875 patent by making it possible to both bend originally straight bar and straighten bent rebar. This is achieved with no or only a negligible increase in the overall length of the machine and its weight, and without significantly increasing its costs.

Generally speaking the improved bending machine of patent No. '779 differs from the bending machine disclosed in the parent patent insofar as it provides the reciprocating slide with a second groove into which bent rebar to be straightened can be placed with, at the most, only a negligible increase in the overall travel length for the slide. The second groove is spaced from the first groove in the direction of slide travel (when bar placed in the first groove is being bent). The second groove is positioned so that bent rebar placed therein is approximately tangent to the peripheries of the forming posts on one side of the posts when straight rebar placed in the first groove is approximately tangent to the peripheries of the forming posts on the other side thereof.

As a result of this positional interrelationship between the first and second grooves the second groove is relatively remote from the forming posts when the slide has been moved the required distance to bend an originally straight bar placed in the first groove. Consequently, within these limits of slide travel a much greater distance is attained between the forming posts and the second groove than between the forming posts and the first groove. This significantly larger distance makes it possible to place a 90 degree bent rebar, for example, into simultaneous engagement with the peripheries of the posts and the second groove by locating the bent portion of the rebar in the second groove.

The bent rebar can be straightened by moving the slide in the opposite direction until the second groove is substantially tangent to the periphery of the posts.

The second groove can be constructed in any one of several configurations. It is important, however, to position the second groove as close as possible to the first groove to avoid interference with the pivot support for the handle which activates the slide, or conversely, to avoid the increase to the spacing between the forming posts and the handle pivot which would again increase the overall length of the device, its weight and cost. In its simplest form, the second groove can be defined by spaced apart, first and second lugs in substantially the same manner in which the first and second lugs of the first groove are constructed. In addition, the adjacent lugs for the two grooves can be combined into a single, double acting lug or post.

Bent rebar, when placed in the second groove, can pivot upwardly out of the groove, depending on the length of the bent rebar, the manner in which it is supported by the machine and/or the surrounding ground etc. The '779 invention also contemplates to constrain the bent rebar in the second groove against such upward movement. To accomplish this another embodiment of the invention defines the second groove partially with one of the lugs for the first groove and a hook, pivotally attached to the lug. The hook can be pivoted over the bent bar in the second groove so that a downwardly oriented free arm of the hook defines a portion of the second groove. Preferably, in this embodiment releasable lock means is provided to secure the hook in either its open or is closed position to prevent an accidental disengagement of the hook from the bar during the bar straightening operation.

Reference is also made to U.S. Pat. No. 4,798,078 and 4,887,447, issued to the present inventor, which adds a cutter to the parent Patent.

SUMMARY OF THE INVENTION

The present invention significantly improves the usefulness of the bending machines disclosed in the above discussed '875 and '779 Patents by making it possible to bend and/or straighten heavier rebar, such as rebar #5, than was conveniently possible with the above discussed bending machines and generally speaking differs from them in so far as the present invention provides additional capabilities which provides additional mechanical leverage to allow the operator to bend or straighten the rebar in increments rather than in one long stroke. This makes it possible for a workman of lessor strength to more easily use the machine in the field. Also, the present invention discloses a new and unique tripping mechanism which either automatically or manually reverses the direction of the slide mechanism by continuance of the same motion of the handle.

Other advantages and improvements will become apparent when taken into consideration with the following specifications and drawings.

DETAILED DESCRIPTION OF THE DRAWINGS

Figure 1:
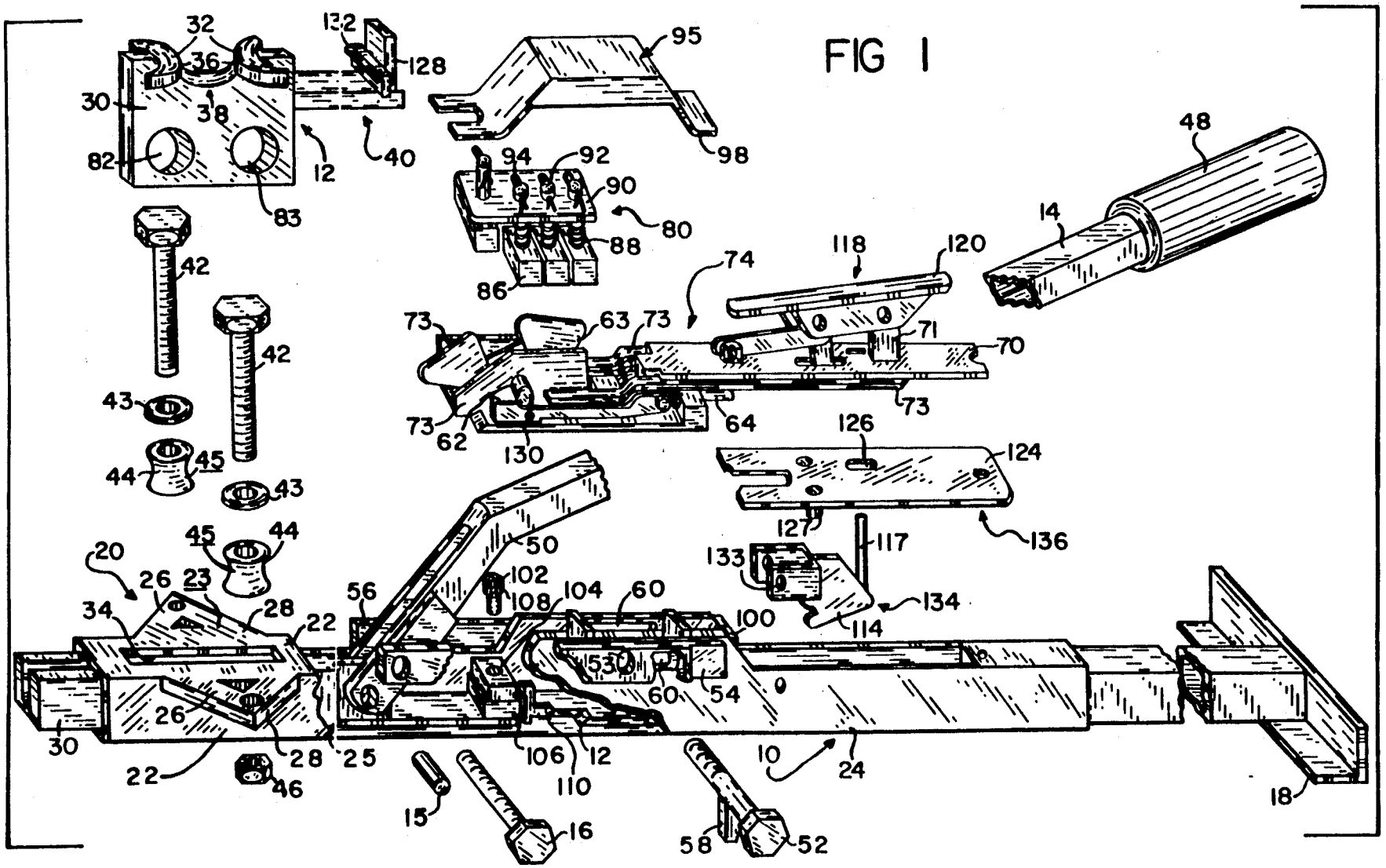
FIG. 1 is an exploded perspective view of the present invention showing most of the several assemblies as they will be assembled into the main frame.

Referring now in detail to the drawings wherein like characters refer to like elements throughout the various drawings, in FIG. 1, 10 is an elongated base supporting a bending mechanism 12 at one end of the base and an actuating handle 14 with free end 48 operatively coupled with a slider by bolt 16 to provide stability for the machine, the base including generally transversely oriented cross legs 18 at one end thereof and a transversely extending yoke 20 at the other end of the base and which forms part of the bending mechanism to reduce the weight of the machine while maintaining rigidity and the base is preferably constructed of steel tubing while the cross legs are preferably angle iron.

Yoke 20 forms one end of the base and supports and houses the bending mechanism 12. It includes a tubular center section 22 which is secured, e.g. welded to or intragrally constructed with the proximate end of an elongated substantially tubular fabricated steel structure 24 which forms the major portion of the base, and a pair of angularly inclined arms 26, 28 which laterally protrude from the center section of the yoke 20 to either side thereof. The free ends of the arms are joined, i.e. welded together, for strength and rigidity. The upwardly facing surfaces of the center section 22 and arms 26, 28 are flat and lie in a common plane to define a flat, horizontal support surface 23 for the rebar to be bent by the machine.

The tubular center section 22, of the yoke 20 defines an internal, elongated linear guideway 25 which linearly recipocally mounts an elongated slider 30.

Figure 7:
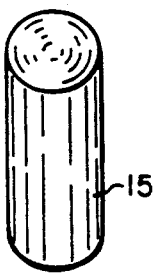
FIG. 7 is a perspective view of an anchor pin (15) (drawn to a different scale).
Figure 19:
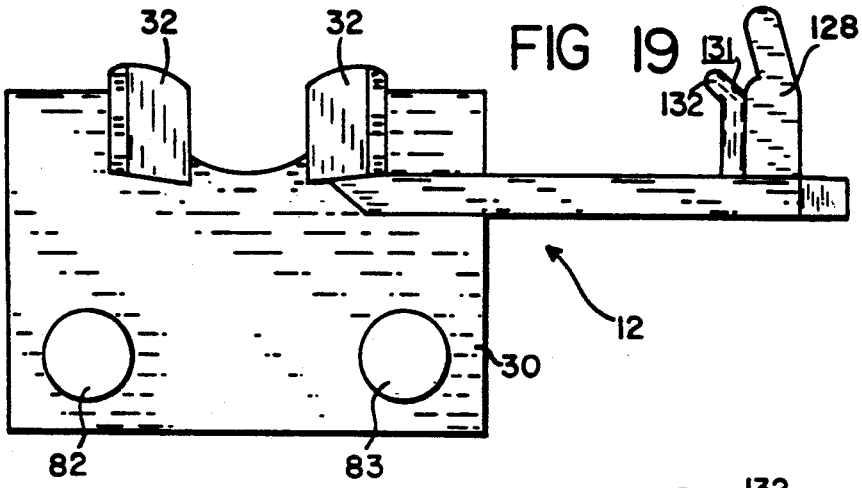
FIG. 19 is a side view of the bending and straightening mechanism (12) as shown in FIG. 1 (drawn to a different scale).
Figure 20:
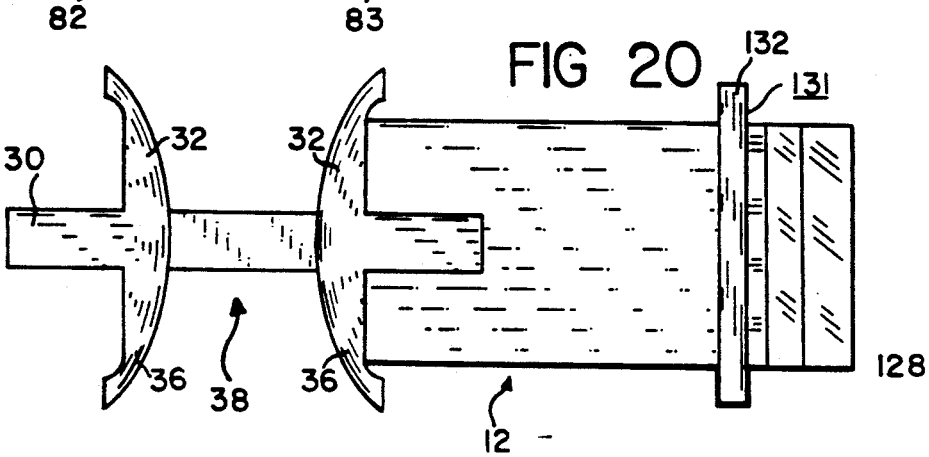
FIG. 20 is a top view of the bending and straightening mechanism (12) as shown in FIG. 1 (drawn to a different scale).
Figure 21:
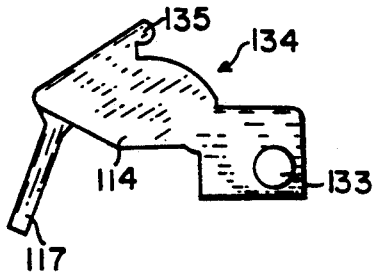
FIG. 21 is a side view of the tripping mechanism (134) as shown in FIG. 1 (drawn to a different scale).

The bending mechanism 12 detailed in FIGS. 19 and 20 includes two pair of spaced apart lugs 32 which protrude from the slider through an elongated, upwardly open slot 34 in the tubular center section 22 of the yoke 20. Lugs 32 have opposing, convexly arcuate bending surfaces 36 which define between them a first groove 38 of sufficient width so that straight rebar to be bent can be placed into the groove. The height of the lugs is greater than the diameter of the largest rebar cabable of being bent by the machine, i.e. the height is greater than the width of groove 38. The slide 30 is mounted by pins as shown in FIG. 7 to slide 30 at traverse mounting holes 82 and 83, respectively.

A pair of bending posts or bolts 42, with washers 43 and nuts 46 are positioned on a line perpendicular to the guideway 25 at the outward end of arms, 26 and 28. Each bending post 42 or bolt is firmly secured, e.g. welded to the yoke and protrudes upwardly past the flat support surface 23. Rollers 44 are rotatably carried by the protruding portions of the bolts 42 and are suitably restrained to the bolts or posts to prevent relative axial movements of the rollers. Each roller has height greater than the diameter of the largest rebar capable of being bent by the machine and concave peripheral surface 45 for nesting the rebar during bending.

Handle 14 is preferably an elongated section of tubular structure of steel having a free end 48 which in length is proximate cross leg 18 and a second end having a lever 50 fixed, i.e. welded to the second end of the handle and is angularly inclined relative to and extending from the handle toward guideway 25. The extreme end of lever 50 is pivotal about a pivot shaft 15, 15 also being a pivot shaft for slider 30. The extreme end of lever 50 is also pivoted at a point above the pivot shaft 15 by a shaft or bolt 16 to a pair of links 54 and 56 respectively, with the distal ends of the links being connected by bolt 52, through traverse holes 53, bolt 52 being fixed, i,e, welded to link 54 and bolt 52 having a U-shaped protrusion 58 fixed, e.g. welded to it on the side close to link 54. Details of the link and U-shaped protrusion is shown in FIGS. 29 and 30, the pair of links translating pivotal movements of handle 14 and the lever 50 into correspondingly reciprocating, linear movements of the slide 30 in guideway 25.

Figure 2:
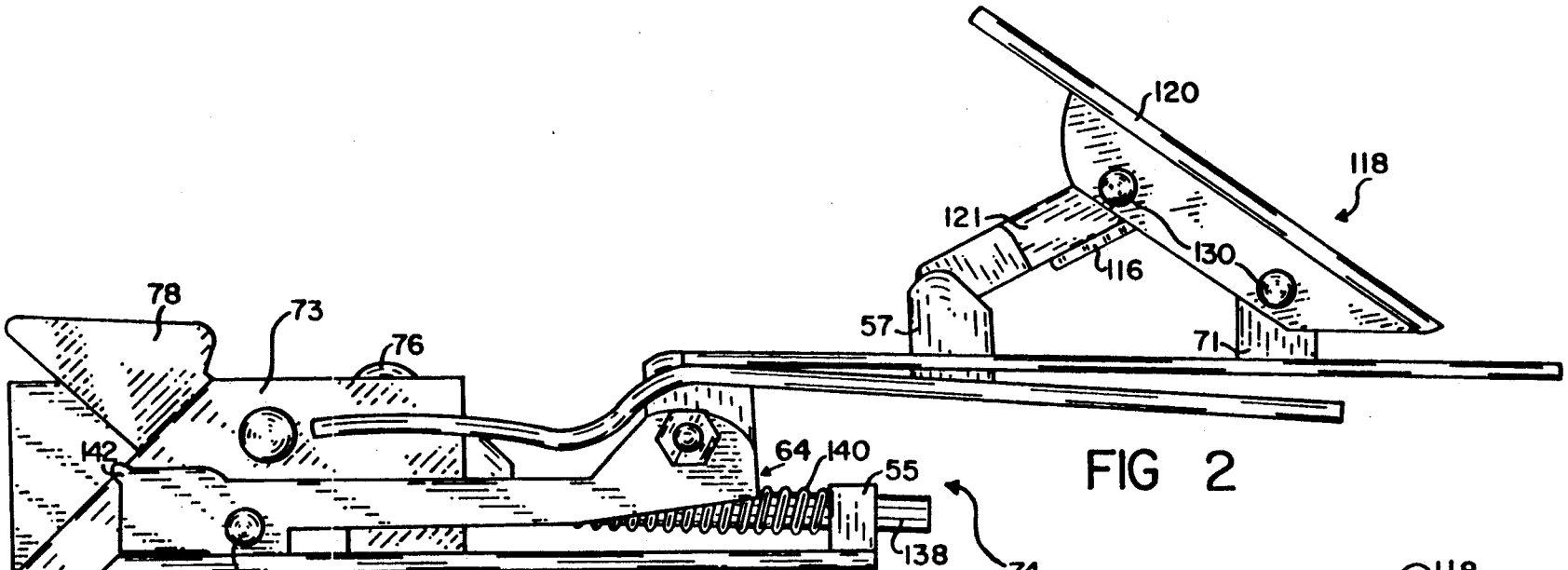
FIG. 2 is a side view of the reversing mechanism (74) (drawn to a different scale) as shown in FIG. 1 in a first position.
Figure 3:
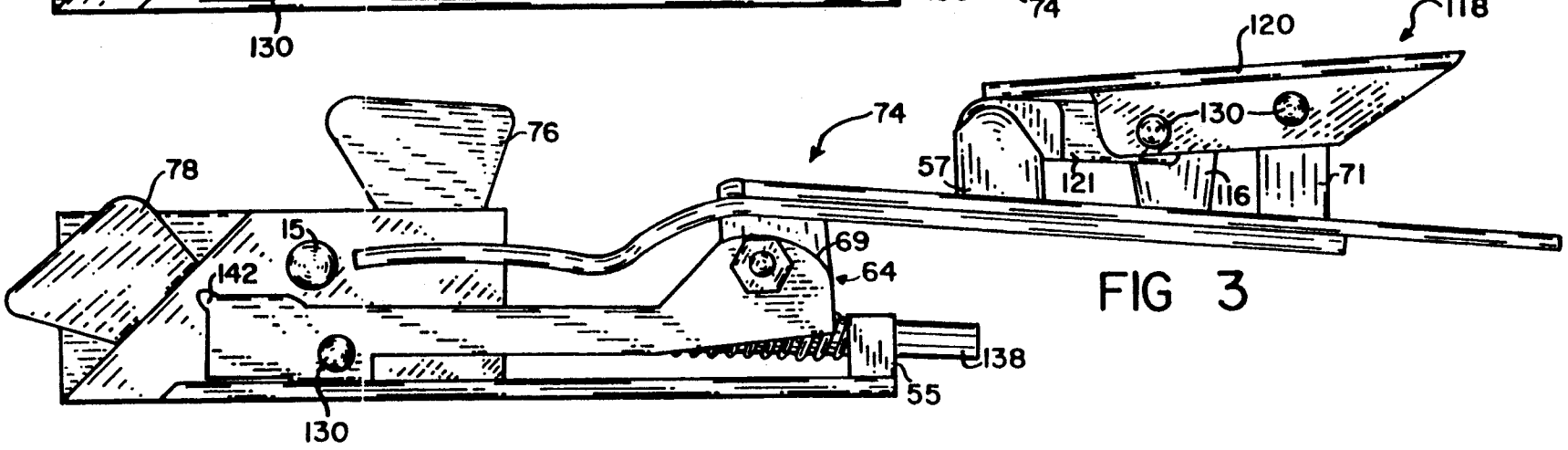
FIG. 3 is a side view of the reversing mechanism (74) (drawn to a different scale) as shown in FIG. 1 in a second position.
Figure 4:
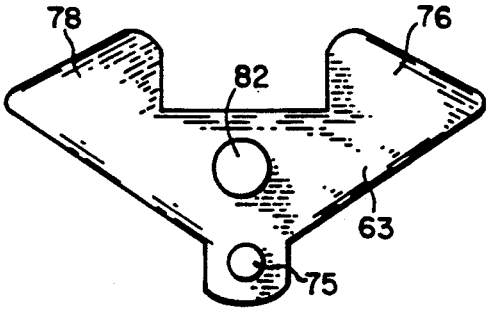
FIG. 4 is a side view of the "butterfly" (63) (drawn to a different scale) of the reversing mechanism as shown in FIG. 1.
Figure 5:
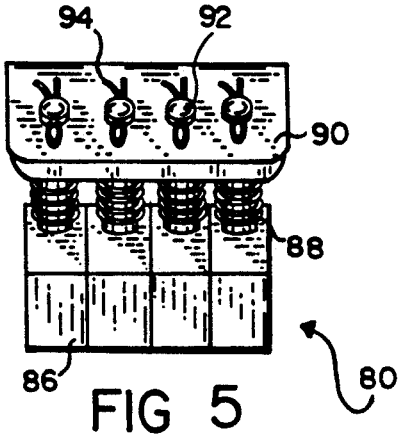
FIG. 5 is a perspective view of a variable stop mechanism (80) (drawn to a different scale) as shown in FIG. 1.
Figure 10:
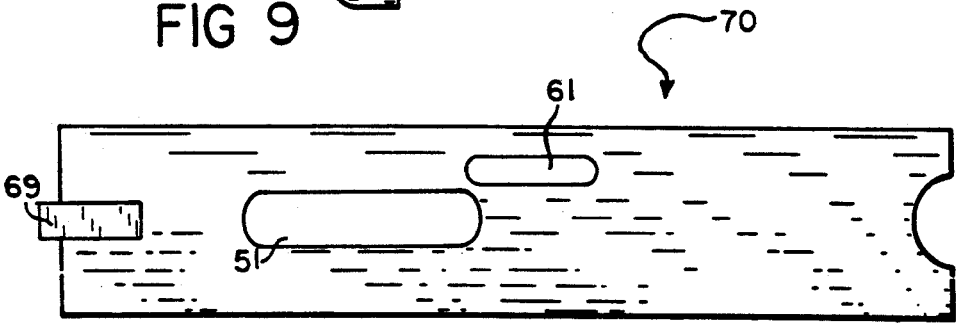
FIG. 10 is a bottom view of the mounting support (70) (drawn to a different scale) as shown in FIG. 1.
Figure 11:
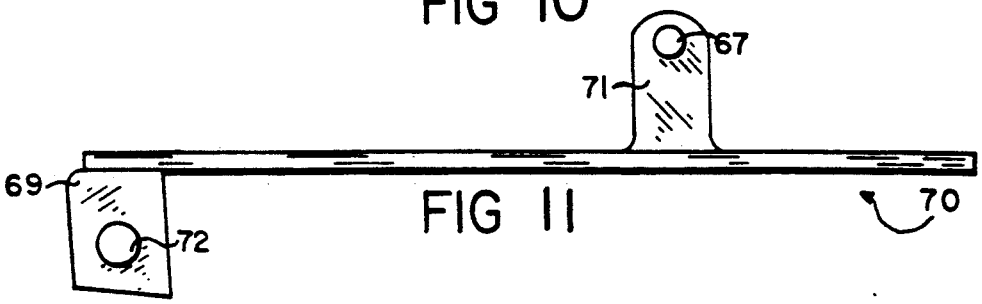
FIG. 11 is a side view of the mounting support (70) (drawn to a different scale) as shown in FIG. 1.
Figure 24:
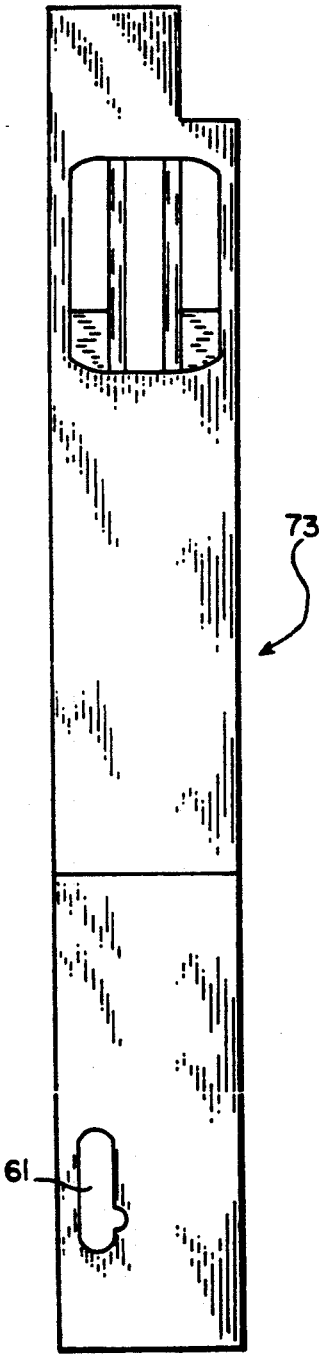
FIG. 24 is a bottom view of the base of assembly (73) as shown in FIG. 1 (drawn to a different scale).
Figure 25:
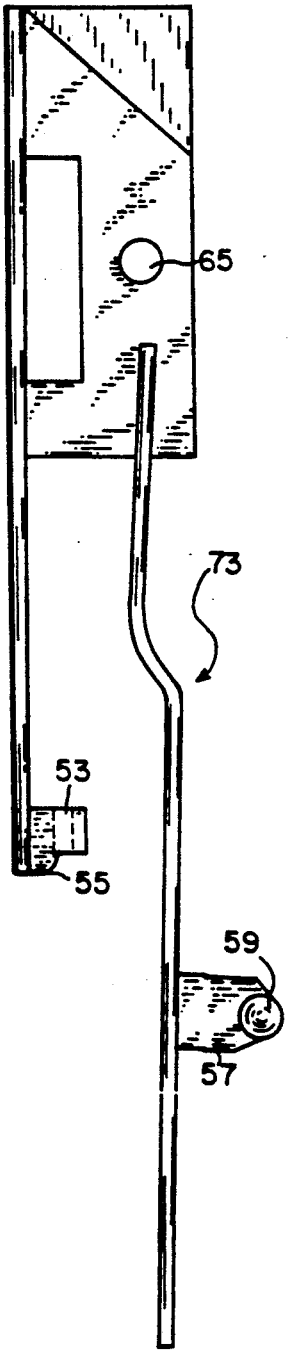
FIG. 25 is a side view of the base of assembly (73) as shown in FIG. 1 (drawn to a different scale).
Figure 26:
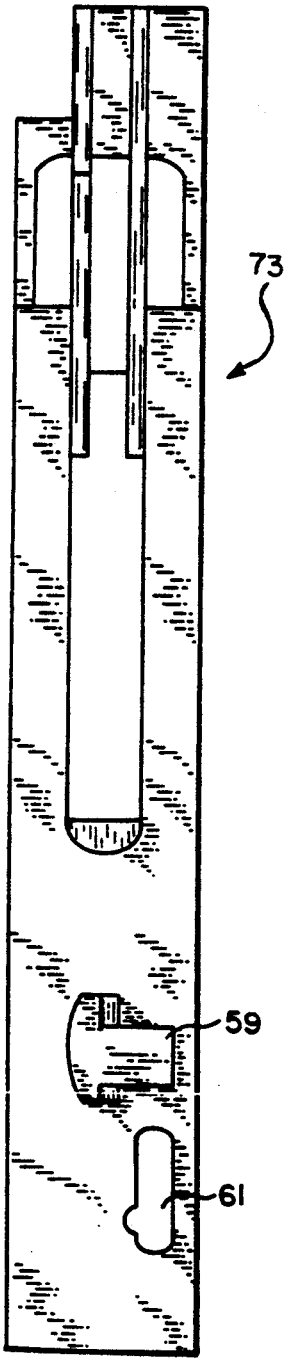
FIG. 26 is a top view of the base of assembly (73) as shown in FIG. 1 (drawn to a different scale).

The bolt 52 is supported and allowed to move linearly in slots 60 in the base 10 while the U-shaped protrusion 58 captures shaft 62 of assembly 74, shaft 62 being mounted through traverse hole 65 of assembly 73, thereby, moving the entire assembly 74 linearly in guideway 25 when the handle 14 is moved. Shaft 62 also supports the butterfly member 63 through traverse hole 82 and also connected by a pin 130 through traverse hole 75 in FIG. 4 to assembly 74 which is pivotable from a first to a second position. The butterfly 63 is maintained in its first or second position by spring loaded linkage assembly 64 as shown in detailed in FIG. 14 and 15 including a pair of links 66 pivoted at 68 and 72 respectively and also joined in assembly 70 as shown in FIG. 10 by protrusion 69 and traverse mounting hole 72. 71 is a protrusion which joins the assembly 70 to pedal assembly 118 through traverse mounting hole 67. Assembly 73 as shown in FIGS. 24 and 26 acts as a mounting support through protrusion 57 and also joins the pedal assembly 118 by mounting pin 59. 55 is also a protrusion with linear hole 53 supporting and guiding spring loaded shaft 138 and is an intricate part of assembly 74 as shown in FIGS. 2 and 3. 51 and 61 are linear slots to allow protrusions 57 and 71 to access assembly 118. FIG. 2 shows a first position while FIG. 3 shows a second position, with the first position in FIG. 2 leaving one wing 76 of the butterfly 62 in a lowered position and the opposite wing 78 in a raised position, while FIG. 3 shows the butterfly wind 76 in a raised position and the butterfly wing 78 in a lowered position. The object of the first and second position of the butterfly wing is to cooperate with assembly 80 to raise or lower the multiple anchor blocks 86 to provide a variable anchor point for bolt 52. Anchor blocks 86 are spring loaded by springs 88 and are mounted on a common plate 90 by shafts 92, shaft 92 being retained by cotterkeys 94.

Figure 6:
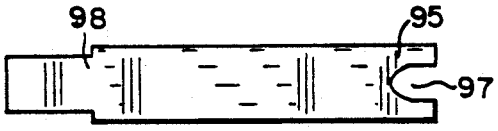
FIG. 6 is a top view of the pan cover (95) drawn to a different scale) as shown in FIG. 1.
Figure 8:
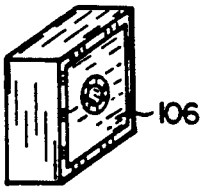
FIG. 8 is a perspective view of a tension and adjusting block (106) (drawn to a different scale).
Figure 9:
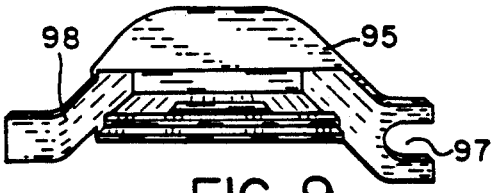
FIG. 9 is a perspective view of the pan cover (95) (drawn to a different scale) as shown in FIG. 1.
Figure 17:
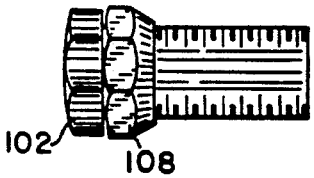
FIG. 17 is an anchor bolt (102) and adjusting jam nut (108) as shown in FIG. 1 (drawn to a different scale).
Figure 18:
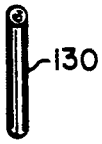
FIG. 18 is a perspective view of a typical assembly pin.

96 is a cover pan detailed in FIGS. 6 and 9 which is retained in place by anchoring the lip 98 under a bar 100 and bolt 102 as shown in FIG. 1. Bolt 102 being threaded into plate 104, plate 104 being fixed e.g. welded to the two sides of base 10 with 106 being a tension block to place adjustable tension on slider 30 by jam nut 108 and bolt 102 as detailed in FIG. 8 and 17.

Figure 15:
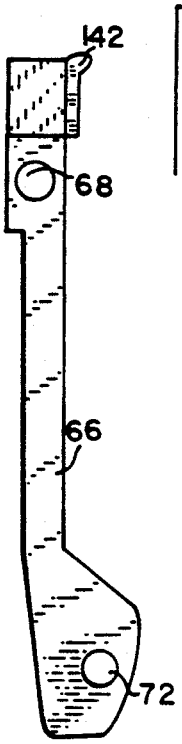
FIG. 15 is a side view of the main body of FIG. 14.
Figure 16:
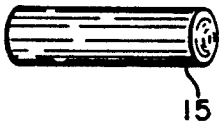
FIG. 16 is an internal pin (15) of FIG. 1 (drawn to a different scale).
Figures 27, 28, 29, 30:
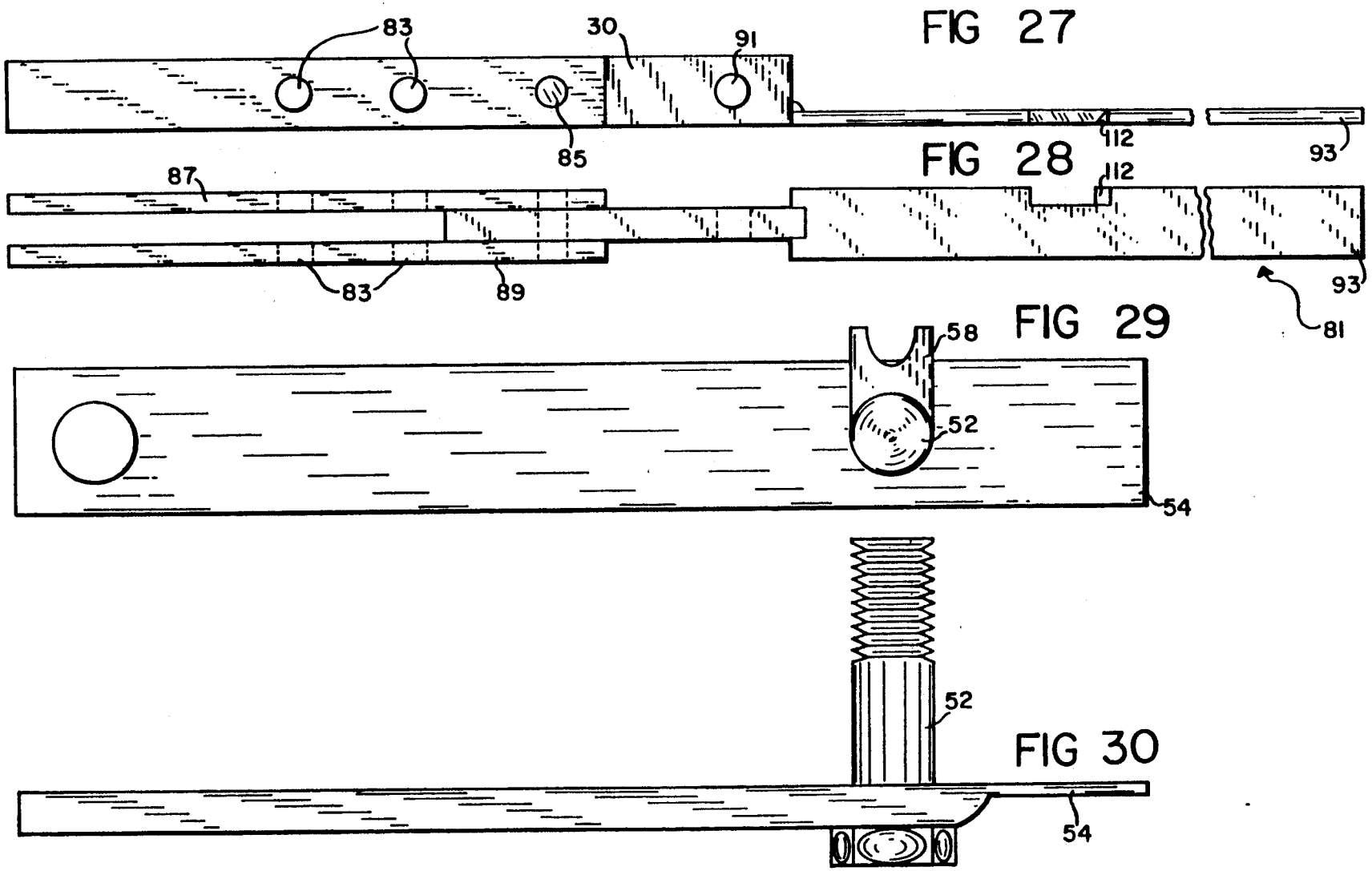
FIG. 27 is a side view of the slider (30) as shown in FIG. 1 (drawn to a different scale).
FIG. 28 is a bottom view of the slider (30) as shown in FIG. 1 (drawn to a different scale).
FIG. 29 is an inside inverted side view of the connecting member (54) as shown in FIG. 1 (drawn to a different scale).
FIG. 30 is a top view of the connecting member (54) as shown in FIG. 1 (drawn to a different scale).

110 in FIG. 1 is a trigger that cooperates with the sloped portion 112 of FIG. 27 and 28 and boss 142 of FIG. 15 and 16 and acts as a triggering mechanism to reverse the direction of the slider 30.

Figure 22:
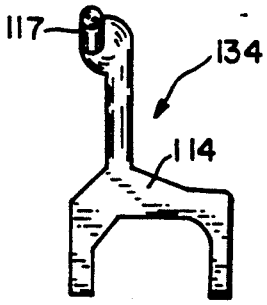
FIG. 22 is an end view of the tripping mechanism (134) as shown in FIG. 1 (drawn to a different scale).

FIG. 22 shows a triggering mechanism 134 that when activated by the distal end of slider 30, raises latching arm 116, as shown in FIGS. 2 and 3 by pin 117 of assembly 118 which may be operated by manually stepping on the pedal 120 which reverses the direction of the slider 30 or when the slider reaches the end of its stroke is triggered by mechanism 134 by boss 135 and automatically reverses the triggering mechanism, 134 being mounted to the base through traverse holes 133.

Figure 14:
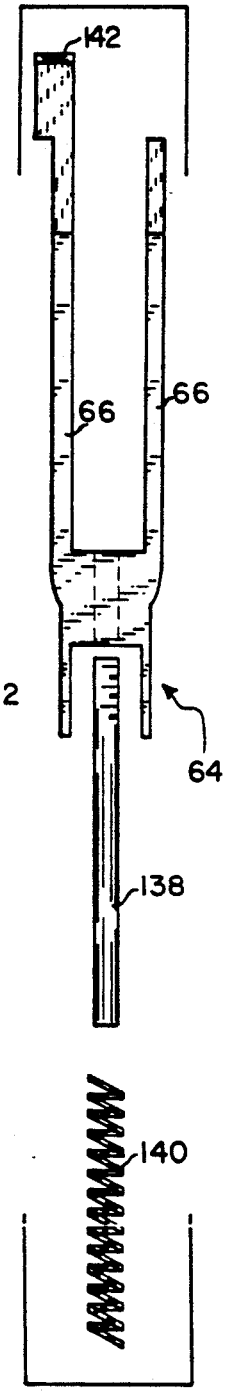
FIG. 14 is an exploded top view of the spring loaded mechanism (64) of FIGS. 2 and 3. (drawn to a different scale).
Figure 13:
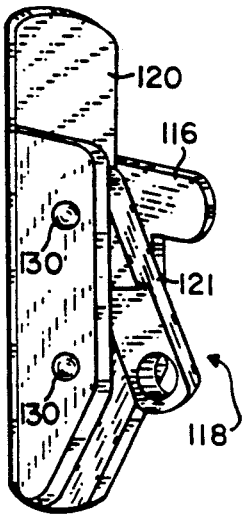
FIG. 13 is a perspective view of foot lever mechanism (118) as shown in FIG. 1 and (drawn to a different scale).
Figure 12:
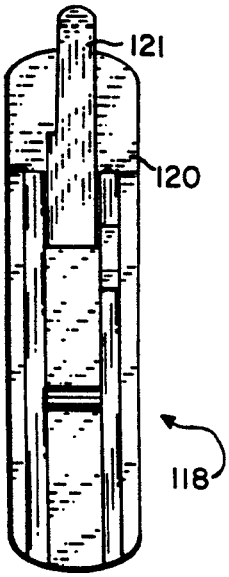
FIG. 12 is a bottom view of the foot lever mechanism (118) (drawn to a different scale) as shown in FIG. 1.
Figure 23:
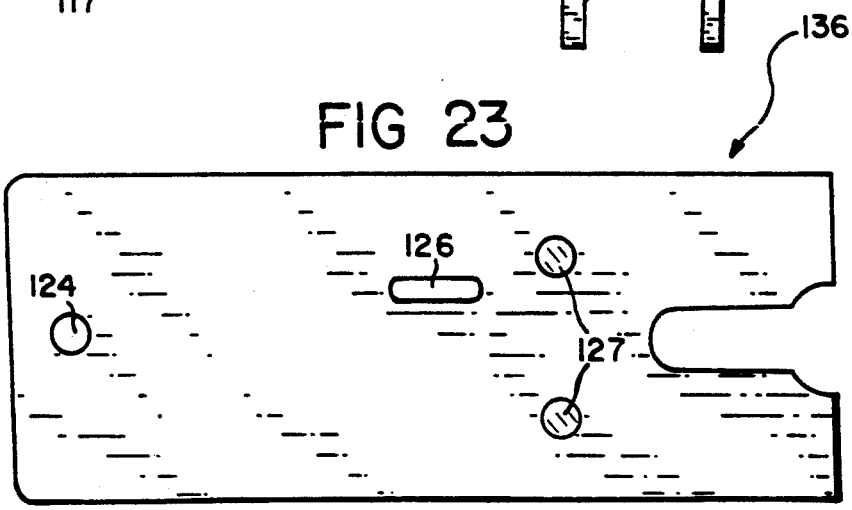
FIG. 23 is a top view of cover plate (136) as shown in FIG. 1 (drawn to a different scale and in a reversed position).

The spring 140 being mounted on shaft 138 of assembly 64 in FIG. 14 provides the force to trigger the mechanism much like a light toggle switch. 136 in FIG. 23 is a cover plate mounted through hole 124, with slot 126 receiving triggering pin 117 of assembly 114, and 127 being guide pins.

In FIGS. 19 and 20 an additional lug 131 is provided which forms a second groove 40 to capture rebar and hold it in place by lip 132 and by reversing the slider by stepping on pedal 120 of assembly 18, the handle is moved in the same manner to straighten rebar.

It will now be seen that we have provided a new and unusual bending machine which is capable of bending or straightening heavy rebar such as #5 in the field by a workman of lessor strength than by using previously patented bending machines as the machine provides a mechanical advantage which allows the workmen to bend or straighten the rebar in increments or in several pulls of the handle. We have also provided means to manually or automatically reverse the mechanism while still operating the handle in the same direction of force. Thus making it unnecessary for the workman to *lift* the handle to straighten rebar in the second groove.

Although the invention has been shown and described in what is conceived to be the most practical and preferred embodiment, it is recognized that departures may be made therefrom within the scope and spirit of the invention, which is not to be limited to the details disclosed herein but is to be accorded the full scope of the claims so as to embrace any and all equivalent devices and apparatus.

Having described our invention, what we claim as new and desire to secure by letters patent is;

1. A hand operated device for bending a metal bar in a horizontal plane comprising; a substantially elongated base having transverse stabilizers attached to first and second ends for preventing lateral tilting of said base when placed on a working surface, said base defining a substantially tubular, linear guideway adjacent said first end and an upwardly open elongated slot communicating with said guideway, said guideway having a predetermined width, first and second spaced apart forming posts projecting generally upwardly from said base, a bar bending mechanism comprising a linearly reciprocating slide mounted within said guideway and movable relative thereto in a direction substantially perpendicular to a line interconnecting centers of said forming posts, said bar bending mechanism including first and second, spaced apart bending means each adapted to engage a bar to be bent when said bar simultaneously contacts a periphery of each said forming posts so that movement of the mechanism deforms said bar, said first bending means comprising; first and second upwardly directed lugs attached to said slide and being spaced apart so as to form a first groove for accepting said bar for bending, said second bending means comprising; means defining a second groove which is spaced from said first groove by a spacing, said second groove defining means being connected with said slide for linear movement therewith, means for moving said bending mechanism in increments, with each of said increments being less than a total movement that said means for moving said bending mechanism is capable of, means to reverse the direction of said slide in relation to the movement of said means for moving said bending mechanism and thereby said first and second bending means moves over a selected pre-determined distance in said increments so that said first bending means moves from a first position at which it is located, in the direction of movement, on one side of said forming posts to a second position at which it is located on another side of said forming posts, said spacing between said first and second bending means being selected so that during such movement said second bending means moves from a first location at which it is proximate a straight line interconnecting the peripheries of said forming post on said another side thereof to a second location at said another side of said forming posts at which it is remote from said forming posts, whereby;

said bar can be bent or straightened in increments by placing said bar in said first or said second bending means by using a similar motion of said means for moving said bending mechanism.

2. The device of claim 1 in which said second bending means includes a lip, said lip cooperating with said bar to restrain said bar from moving.

3. The device of claim 1 in which said means for moving said bending mechanism in increments includes a handle, said handle having first and second spaced apart transverse mounting holes at one of its ends, said first hole being located substantially at an extreme end of said handle and connected through said hole by a pin to said slider, said slider having a first and second end and a center section, said first end being substantially an elongated U, said center section being substantially of the same shape and size of said guideway, said first end having transverse mounting holes to accept at least two pins, said mounting holes and said pins cooperating to mount said bar bending mechanism, said second end being an elongated plate, said plate being substantially of the size of the bottom of said guideway, said slider being captured by and cooperating with said guideway of said base, said slider having adjustable tension means, a pair of links lying parallel to and on the outside of said base and handle, said links having first and second ends, said first ends having transverse mounting holes and being connected through said holes to said handle by a bolt and nut through said second hole in said handle, said second ends of said links having transverse mounting holes and being connected together by a second bolt and nut, a pair of parallel elongated linear slots in substantially a raised center portion of the sides of said base, said slots cooperating with and providing guide means for linear movement of said second bolt which lies transversly through said slots, the head of said second bolt being affixed to one of said links, a U-shaped protrusion affixed to said second bolt between said links substantially near said head end of said second bolt, said handle, said links, said bolts and said slider cooperating with said means for moving said bending mechanism in increments and said means to reverse the direction of said slider.

4. The device of claim 3 in which said means for moving said bending mechanism in increments includes multiple blocks, said blocks being mounted in individual shafts, said shafts being surrounded by a compression spring, said blocks having a first and second position, said blocks being mounted adjacent each other on a common plate by said shafts, retaining means to hold an open end of said shafts into mounting holes on said common plate, said blocks and said common plate being housed in the space between said substantially raised center portions of said sides of said base, said U-shaped protrusion being in working communication with a pin, said pin being an intragal part of a mounting frame, a portion of said mounting frame being located below said blocks, said frame supporting a butterfly, said butterfly having pivoting means on said frame, said butterfly having a first and second position, said first position aligning a first wing of said butterfly beneath and below said blocks, said second position aligning a second wing of said butterfly beneath and below said blocks, whereby;

when motion of said handle moves said linkage, said U-shaped protrusion, said pin, said supporting frame and said butterfly, said blocks are forced one by one from their said first position to their said second position thus providing multiple stops for said second bolt of said linkage and when said means to reverse said direction of said slide is activated, said butterfly assumes its said second position thus raising said blocks back to their said first position and when continued motion of said handle moves said linkage, said U-shaped protrusion, said pin, said supporting frame and said butterfly in the opposite direction, said blocks are forced one by one from their said first position to their said second position thus providing multiple stops for said second bolt of said linkage.

5. The device of claim 4 in which said means to reverse the direction of said slide includes a spring loaded yoke, said yoke having a first and second position, said yoke having links, said links lying parallel to and on the outside of said mounting frame, said links having first and second ends, said first end having transverse mounting holes and being connected through said holes to a transverse mounting hole in said butterfly by a pin, said mounting hole being below said pivoting means of said butterfly, said second ends of said links having transverse holes, a slide plate, said plate having a first protrusion in its lower side, said first protrusion having a transverse hole and being connected through said hole to said second end of said links by a bolt and nut, said plate having a second protrusion on its upper side, said second protrusion having a transverse hole, a pedal, said pedal having on its bottom side a pair of parallel third protrusions, said third protrusions having first and second ends, said first ends having aligned transverse holes, said pedal being movably attached to said plate by a pin through said holes of said parallel third protrusions and said hole in said second protrusion on said upper side of said plate, said plate having a first and second linear, elongated slots substantially located in its center portion, said first slot providing a guide for a fourth protrusion afficed to said mounting frame, said forth protrusion supporting a pin, a link, said link having first and second ends, said ends having transverse mounting holes, said link being movably attached at its said first end to said last named pin of said fourth protrusion, said link being movably attached at its said second end to said pedal by a pin through said hole in said second end of said link through said holes in said second end of said third protrusions of said pedal, said pedal having an extension on one of its pairs of said parallel third protrusions, said pedal having a first and second position, said first position forcing said extension into said second elongated slot of said plate, a triggering mechanism, said triggering mechanism having a shaft extension, said shaft being in communication with said second elongated slot of said plate, said triggering mechanism being pivotably mounted between said sides of said base, said triggering mechanism having a boss on its lower side, said boss being in alignment and communicating with an inside end of said elongated, linearly reciprocating slider, whereby;

when said reciprocating slider comes in contact and moves said boss of said triggering mechanism, said shaft of said triggering mechanism engages said extension on said pedal forcing said pedal past its dead center, which activates said spring loaded yoke to its said first position which causes said butterfly to assume an opposite position which in turn causes reversal of the direction of said bending mechanism.

6. The device of claim 5 including a second substantially L-shaped triggering mechanism with pivotable mounting means on an inside of one of the sides of said base, said second triggering mechanism cooperating with a wedge shaped slot in said reciprocating slider, whereby;

when said slider reaches a maximum frontal position, said wedge shaped slot activates said second triggering mechanism to engage a boss on one of said links on said spring loaded yoke thus forcing said yoke into its said second position and reversing the direction of said bending mechanism.

7. The device of claim 3 in which said adjustable tension means of said slider includes a first cross bar suitably affixed across a top of said base, having a downwardly threaded hole, said hole located above the said elongated plate of said second end of said slider, a substantially square block, said block being substantially of a size of said width of said guideway and of a height to fit beneath said cross bar and on top of said elongated plate, a bolt, a jam nut, said bolt, said threaded hole, said cross bar and said jam nut cooperating together to provide adjustable tension on said block and said elongated plate.

8. The device of claim 7 including a cover pan covering said multiple blocks, said pan having a first and second end, said first end having a first lip, said first lip cooperating with a second cross bar on substantially a top of a raised center portion of the sides of said base to secure said first end to said base, said second end of said pan having a second lip, and said second lip having an elongated slot cooperating with said bolt and said jam nut to secure said second end to said base.

9. The device of claim 5 including a cover plate, said cover plate being affixed at one of its ends to said base by a screw, said cover plate covering that portion of said base housing said triggering mechanism and said cover plate having an elongate slot located in proximity to said shaft of said triggering mechanism.

10. The device of claim 1 in which said forming posts support rollers and said rollers having convexly arcuate bending surfaces.

* * * * *